US005673489A

United States Patent [19]

Robell

[11] Patent Number: 5,673,489

[45] Date of Patent: Oct. 7, 1997

[54] GRIDDED MEASUREMENT SYSTEM FOR CONSTRUCTION MATERIALS

[76] Inventor: Glenn Robell, P.O. Box 1675, Tampa, Fla. 33601

[21] Appl. No.: 599,986

[22] Filed: Feb. 14, 1996

[51] Int. Cl.[6] ..... G01B 3/00

[52] U.S. Cl. ..... 33/1 B; 33/566

[58] Field of Search ..... 33/1 B, 1 BB, 33/1 G, 1 K, 15 D, 404, 411, 194, 494, 562, 563, 566; 52/105

[56] References Cited

U.S. PATENT DOCUMENTS

| | | | |
|---|---|---|---|
| 275,822 | 4/1883 | Hagan | 33/1 K |
| 752,617 | 2/1904 | De Pue | 33/1 B |
| 2,375,427 | 5/1945 | Mannino | 33/1 B |
| 4,599,798 | 7/1986 | Steele | 33/1 B |
| 4,730,398 | 3/1988 | Stanton | 33/1 K |
| 4,827,621 | 5/1989 | Borsuk | 33/1 B |
| 4,858,402 | 8/1989 | Putz | 52/105 |
| 4,870,788 | 10/1989 | Hassan | 52/105 |
| 4,924,644 | 5/1990 | Lewis | 52/105 |
| 5,282,317 | 2/1994 | Carter et al. | 33/1 B |
| 5,477,617 | 12/1995 | Guy | 33/1 SB |

FOREIGN PATENT DOCUMENTS

| | | | |
|---|---|---|---|
| 529509 | 6/1955 | Italy | 33/1 B |
| 1578521 | 11/1980 | United Kingdom | 33/1 B |

*Primary Examiner*—G. Bradley Bennett
*Attorney, Agent, or Firm*—Dorothy S. Morse

[57] ABSTRACT

A means of gridded measurement for the cuing of construction materials which comprises the imprinting of commonly used measurement markings upon the surfaces of construction materials during the manufacturing process to save time and improve the accuracy of cutting the construction materials on a job site. Unit markings may be numbered for quick dimensional reference and fractional markings may also be used. The lines for commonly used markings may also be highlighted, darkened, doubled, tripled, dashed or dotted, and color enhanced for easy recognition. Applications may include, but are not limited to, use on wallboard, shower board, insulation, gypsum board, plywood, and any other material which must be cut to exact measurements on a construction job site. Angled cuts may be easily made by cutting along the opposite corners of a predetermined number of grids counted in both horizontal and vertical directions.

24 Claims, 2 Drawing Sheets

GRIDDED MEASUREMENT SYSTEM FOR CONSTRUCTION MATERIALS

BACKGROUND

1. Field of the Invention

This invention relates to methods and devices for accurately cutting construction materials, specifically to a time saving means and a means by which to improve the accuracy of cutting construction materials on a job site which involves the imprinting during manufacture of gridded measurement markings onto the surfaces of construction materials. Applications may include, but are not limited to, use on wallboard, shower board, insulation, gypsum board, plywood, and any other material which must be cut to exact measurements on a construction or renovation job site.

2. Description of Prior Art

During construction and renovation projects building materials must be accurately measured prior to cutting to ensure that they will perform the functions for which they were intended. If building materials are mismeasured and are found to be too large, additional time must be spent to recut or reshape them, which causes delay in completion of a construction or renovation project. If the materials are cut too small and used, gaps may be present which detract from the appearance of the finished structure, and the functional integrity of the structure may be compromised. Materials cut too small and discarded result in financial loss. Therefore, it is desirable to have a means for accurately and expediently cutting building materials on a construction or renovation job site.

One of the simplest ways to create a smaller piece of construction material out of a larger one is to use a tape measure and a marking device to place several small marks upon the surface of the larger piece of building material at a measured distance from a straight edge. One may then use the marks themselves as an approximate cutting guide. In the alternative, by use of the marking device and tape measure, or another straight edged device, one may connect the small marks to form a line which then is used as the cutting guide. One disadvantage of this measurement procedure is the time it takes to measure and connect each of the small marks. Usually, the more small marks used, the more accurate the cut will be on a large piece of construction material, but it is also more time consuming to measure and inscribe additional small marks on the piece of construction material. Another disadvantage is the human error involved in measuring multiple small marks. Tired people, those working outside in the sun for extended hours, and those pressured to finish a project in a short period of time, do not always focus their attention on the tape measure markings and may misread them, especially the fractional markings. Thickly marked lines may also lead to cutting errors, particularly when a variance in the part of the thick line cut is extended the full length of a four foot by eight foot, four foot by ten foot, or four foot by twelve foot sheet of construction material. The mistakes which result waste both time and materials if they are not caught prior to the cutting of the construction materials.

Cutting tools are known which aid in making precise cuts in drywall and other construction materials. The invention in U.S. Pat. No. 5,206,965 to Rowley (1993) discloses a utility knife with an angled structure associated with its housing which provides a guiding surface for making angled or mitered cuts along the edge of a piece of construction material, such as drywall. The invention in U.S. Pat. No. 5,265,342 to Lang, Jr. (1993) discloses a knife fastened to a rod which passes through an opening in a guide that rides along the edge of a piece of construction material. Graduations on the rod allow new cut widths without the use of tape measures and marking devices. One disadvantage of using the Lang, Jr. cutting tool is that it is only able to cut lines which are parallel to the straight edge along which the guide is placed. Angled and mitered cuts are not possible with the Lang, Jr. invention. It is not known to have construction materials which have grids comprising commonly used measurement markings imprinted thereon as a time saving means, a means by which to improve the accuracy of cutting the construction materials on a job site, and a means by which angled and mitered cuts may be expediently made on pieces of construction material.

SUMMARY OF INVENTION - OBJECTS AND ADVANTAGES

It is the primary object of this invention to provide a means by which to improve the accuracy of cutting pieces of construction materials to prevent waste of construction materials. It is also an object of this invention to provide a time saving means by which to accurately cut pieces of construction materials. A further object of this invention is to provide an easy and expedited means for making angled or mitered cuts on pieces of construction materials. It is also an object of this invention to provide imprinted measuring grids on pieces of construction material which are sized and highlighted in a variety of commonly used measuring units. A further object of this invention is to provide imprinted measuring grids having fractional measurements.

As described herein, properly manufactured and imprinted on a piece of construction material, the present invention would provide a time saving means of accurately cutting the construction material. Numerals would be indicated in association with whole measuring units for fast identification of the dimensions which are required for a cut. Fractional markings would also be available for increased precision in cutting the construction material. It is contemplated for the lines marking commonly used measurements, such as the sixteen inch measurement between studs, to be highlighted, darkened, doubled, tripled, dashed, dotted, or color enhanced on the grid for quick reference. Angled and mitered cuts could be easily made by cutting along the opposite corners of a predetermined number of grids counted in both horizontal and vertical directions. The gridded measurement markings provide a quick measurement reference, but they also provide convenient guides for cutting a straight line through a piece of construction material. Also, a quick look at the markings on a previously cut piece of construction material having the grid measurement system of the present invention will reveal the presence of a straight edge or a 90-degree angle between adjacent edges without measurement.

The description herein provides preferred embodiments of the present invention but should not be construed as limiting the scope of the gridded drywall invention. Variations in the units used to configure the grids, the selection of fractional markings displayed, the selection of commonly used construction measurements chosen for highlighting, darkening, doubling, tripling, dashing, dotting, or color enhancing, the frequency of the numerals used to identify grid units, and the use of numerals for other grid measurement markings, other than those shown and described herein, can be incorporated into the present invention. Thus the scope of the present invention should be determined by the appended claims and their legal equivalents, rather than the examples given.

DETAILED DESCRIPTION OF PREFERRED EMBODIMENTS

Figure 1:
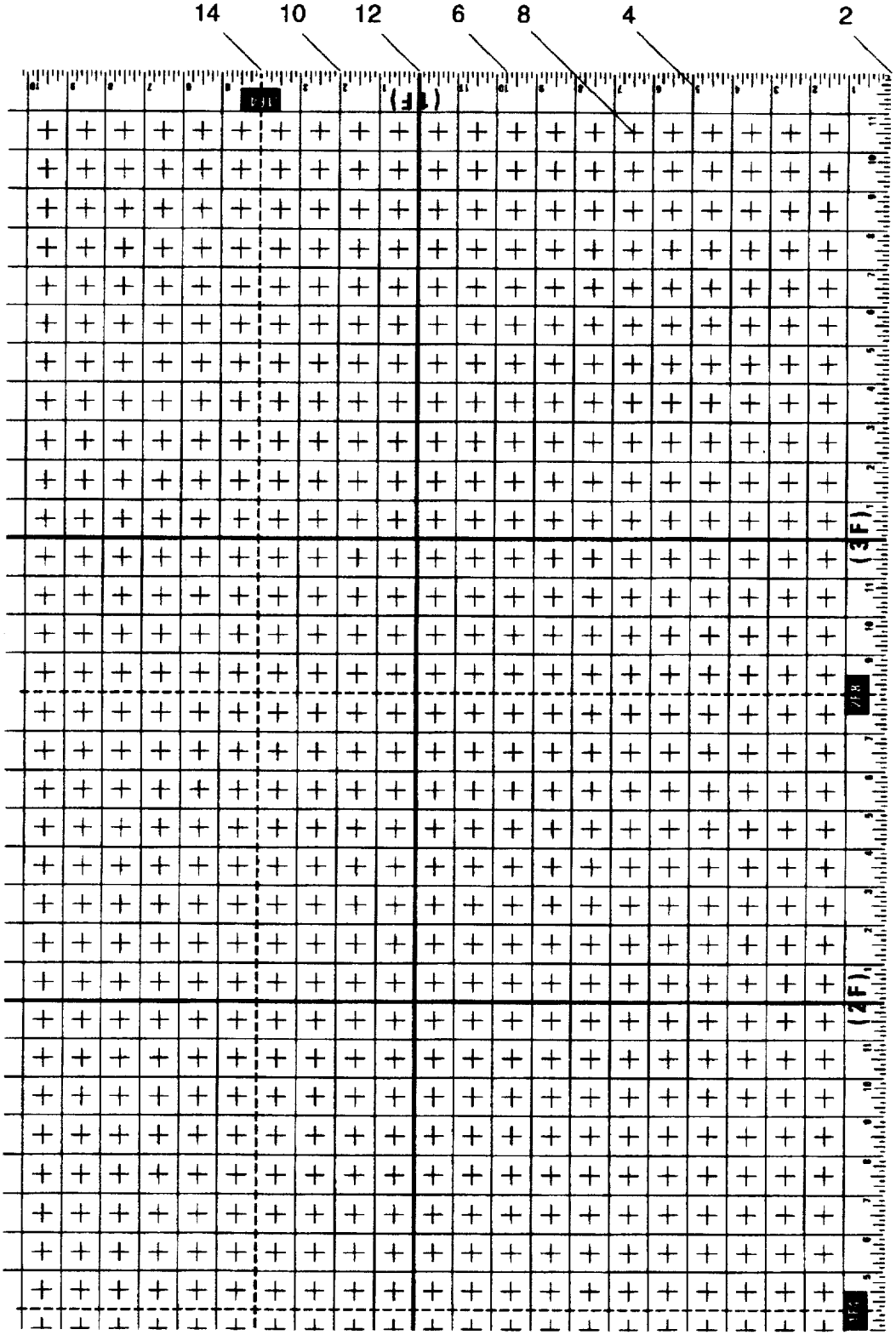
FIG. 1 is a top view of the invention having multiple highlighted markings.
Figure 2:
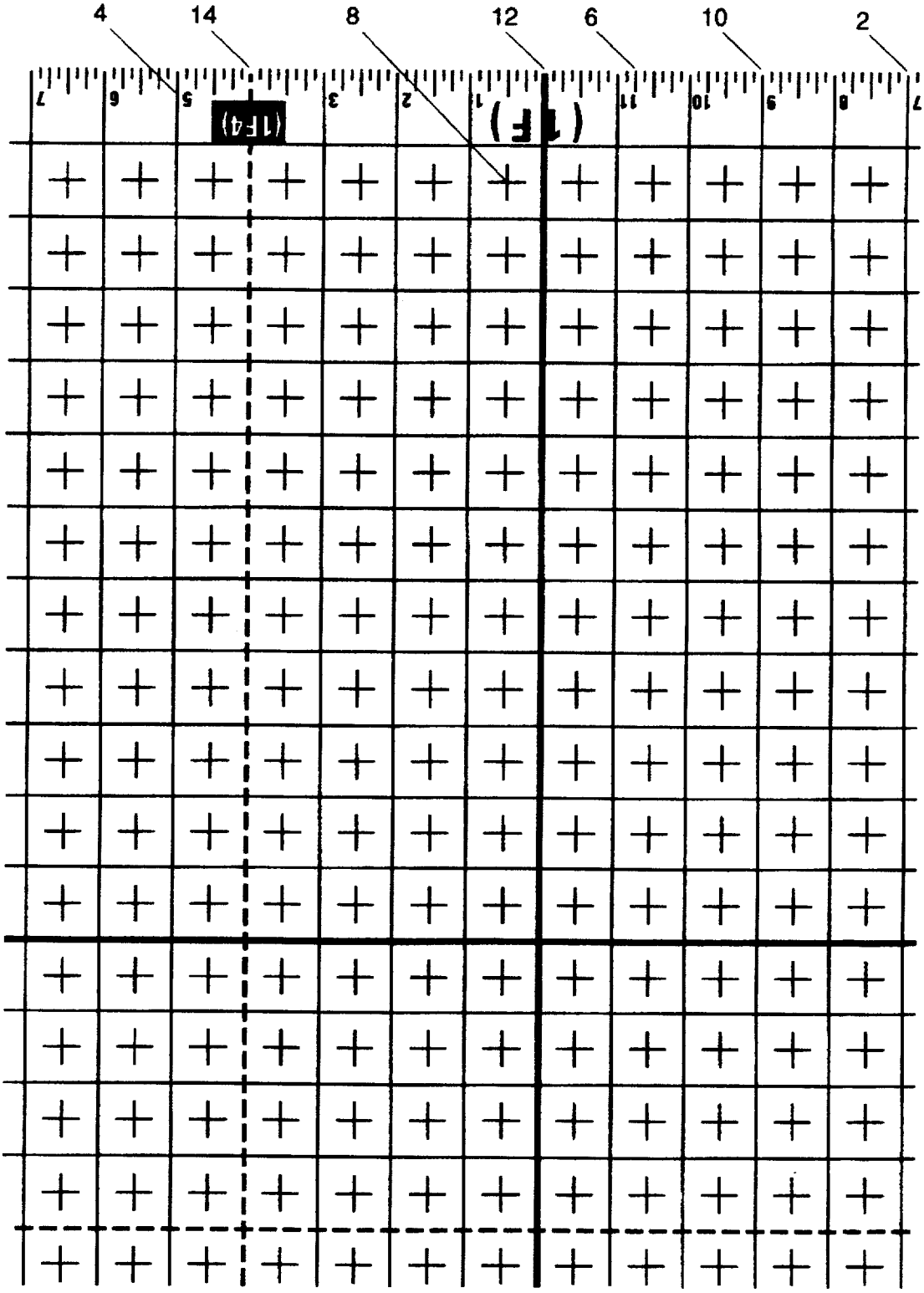
FIG. 2 is an enlarged top view of the invention.

FIGS. 1 and 2 show a preferred embodiment of a grid measurement system 2 for use with a variety of building materials (not shown) to include wallboard, shower board, insulation, gypsum board, plywood, and any other material, particularly four foot by eight foot, four foot by ten foot, and four foot by twelve foot sheets, which must be cut to exact measurements on a construction or a renovation job site. FIGS. 1 and 2 show grid measurement system 2 having one-fourth inch markings 6, one-half inch markings 8, one inch markings 10, twelve inch enhanced markings 12, and sixteen inch highlighted markings 14 indicated in both horizontal and vertical directions. Sixteen inch highlighted markings 14 are used as a quick reference for the sixteen inch distance commonly used in the construction industry between studs (not shown). FIGS. 1 and 2 also show grid measurement system 2 having numerals 4 associated with one inch markings 10.

Although the preferred embodiment of grid measurement system 2 shows markings in inches, it is contemplated for markings to also be in other commonly used measurement units, such as metric units. Further, it is also contemplated for numerals 4 to be associated with markings other than one inch markings 10, and to be associated with either odd or even one inch markings 10. In addition, it is contemplated for commonly used measurements, other than twelve inch markings 12 and sixteen inch markings 14 to be highlighted or enhanced. It is also contemplated for highlighting and enhancing to include, but not be limited to, color enhancement, darkening of lines, doubling of lines, tripling of lines, and a series of dots adjacent to or in place of a line. Highlighting could also include dashed lines with each dashed mark having an identical measurement useful to the construction industry, such as one-half inch marking 8 with spaces between each dashed mark also having the same identical measurement. Although FIGS. 1 and 2 show one-fourth inch markings 6 and one-half inch markings 8, it is contemplated to have other fractional markings as needed to suit a particular construction purpose.

Angled and mitered cuts are easy to make using grid measurement system 2. A 45-degree angled cut may be made without measurement by cutting through opposite corners of one inch markings 10. Other angles may be cut along the opposite corners of a predetermined number of one inch markings 10 counted in both horizontal and vertical directions. For convenience in cutting such angles, a straight edge (not shown) and a marking device (not shown) may be used to draw a line connecting the counted opposite corners. However, no angle measurements need to be determined, a process which is commonly the subject of human error. It is contemplated for grid measurement system 2 to be imprinted on construction materials of any thickness, including all four foot by eight foot, four foot by ten foot, and four foot by eight foot construction materials. Grid measurement system 2 may be imprinted for an insignificant cost, as compared to the cost of the construction material itself (not shown), by screen printing, laser guided printing or pad printing.

What is claimed is:

1. A gridded measurement system for use on at least one surface of a rectangular piece of construction material so as to provide a visually precise means for fast and accurate cutting of construction materials whereby use thereof will reduce construction costs by minimizing the amount of labor required to measure construction materials as well as minimizing material waste due to inaccurate cutting of construction materials, said gridded measurement system comprising a plurality of precise horizontal unit measurement markings and a plurality of precise vertical unit measurement markings positioned around the perimeter of the construction material surface, a plurality of successively higher numbers associated with said unit measurements markings a plurality of grid markings positioned between said horizontal unit measurement markings, and said vertical unit measurement markings said grid markings substantially filling the construction material surface between said horizontal unit measurement markings and said vertical unit measurement markings, each of said grid markings also having a spaced arm horizontal distance from the next adjacent one of said grid markings which is identical to the dimension of said horizontal unit measurement markings and a spaced apart vertical distance from the next adjacent one of said grid markings which is identical to the dimension of said vertical unit measurement markings, said system also comprising marking means for visually precise marking of said unit measurement markings, said grid markings, and said successively higher numbers onto the piece of construction material.

2. The gridded measurement system of claim 1 wherein said visually precise units measurement markings are positioned on construction materials selected from a group consisting of four foot by eight foot sheets, four foot by ten foot sheets, and four foot by twelve foot sheets.

3. The gridded measurement system of claim 1 further comprising a plurality of visually precise fractional measurement markings positioned in both horizontal and vertical directions on said construction material surface between said unit measurement markings.

4. The gridded measurement system of claim 1 further comprising a plurality of highlighted markings positioned in both horizontal and vertical directions on top of the ones of said unit measurement markings which are commonly used in the construction industry so that said highlighted markings may be quickly referenced.

5. The gridded measurement system of claim 4 wherein said highlighted markings are select from a group consisting of color enhanced markings, multiple lines, and dashed lines having a plurality of segments identical in length and positioned at equally spaced apart distances from one another.

6. The gridded measurement system of claim 1 wherein said highlighted markings comprise multiple lines.

7. The gridded measurement system of claim 1 wherein said unit markings comprise one inch markings.

8. The gridded measurement system of claim 7 further comprising a plurality of highlighted markings positioned in both horizontal and vertical directions on top of every of said unit markings which is a multiple of twelve for quick reference.

9. The gridded measurement system of claim 7 further comprising a plurality of highlighted markings positioned in both horizontal and vertical directions on top of every one of said unit markings which is a multiple of sixteen for quick reference.

10. The gridded measurement system of claim 1 wherein said unit markings comprise metric system markings.

11. The gridded measurement system of claim 1 wherein said marking means is selected from a group consisting of screen printing equipment, laser printing equipment, and pad printing equipment.

12. The gridded measurement system of claim 1 further comprising a plurality of visually precise inter-grid markings consisting of fractional measurement markings positioned in both horizontal and vertical directions on said construction material surface between said grid markings to provide a grid within a grid configuration for enhanced cutting accuracy.

13. A gridded measurement system for use on at least one surface of a rectangular piece of construction materials as to provide a visually precise means for fast and accurate cutting of construction material so whereby use thereof will reduce construction costs by minimizing the amount of labor required to measure construction materials as well as minimizing material waste due to inaccurate cutting of construction materials, said gridded measurement system comprising a plurality of precise horizontal unit measurement markings and a plurality of precise vertical unit measurement markings positioned around the perimeter of the construction material surface, a plurality of successively higher numbers associated with said unit measurements markings, a plurality of grid markings positioned between said horizontal unit measurement markings and said vertical unit measurement markings, said grid markings substantially filling the construction material surface between said horizontal unit measurement markings and said vertical unit measurement markings, each of said grid markings also having a spaced apart horizontal distance from the next adjacent one of said grid markings that is identical to the dimension of said horizontal unit measurement markings and a spaced apart vertical distance from the next adjacent one of said grid markings that is identical to the dimension of said vertical unit measurement markings, said system also comprising a plurality of visually precise fractional measurement markings positioned in both horizontal and vertical directions on the construction material surface between said unit measure merit markings, a plurality of highlighted markings positioned in both horizontal and vertical directions on top of the ones of said unit markings which are commonly used in the construction industry so that said highlighted markings may be quickly referenced, and marking means for visually precise marking of said unit measurement markings, said grid markings, and said successively higher numbers onto the piece of construction material.

14. The gridded measurement system of claim 13 wherein said visually precise units measurement markings are positioned on construction materials selected from a group consisting of four foot by eight foot sheets, four foot by ten foot sheets, and four foot by twelve foot sheets.

15. The gridded measurement system of claim 13 wherein said highlighted markings are selected from a group consisting of color enhance markings, multiple lines, and dashed lines having a plurality of segments identical in length and positioned at equally spaced apart distances from one another.

16. The gridded measurement system of claim 13 wherein said unit markings comprise one inch markings.

17. The gridded measurement system of claim 13 further comprising a plurality of highlighted markings positioned in both horizontal and vertical directions on top of every of said unit markings which is a multiple of twelve for quick reference.

18. The gridded measurement system of claim 13 further comprising a plurality of highlighted markings positioned in both horizontal and vertical directions on top of every one of said unit markings which is a multiple of sixteen for quick reference.

19. The gridded measurement system of claim 13 wherein said unit markings comprise metric system markings.

20. The gridded measurement system of claim 13 wherein said marking means is selected from a group consisting of screen printing equipment, laser printing equipment, and pad printing equipment.

21. The gridded measurement system of claim 13 further comprising a plurality of visually precise inter-grid markings consisting of fractional measurement markings positioned in both horizontal and vertical directions on said construction material surface between said grid markings to provide a grid within a grid configuration for enhanced cutting accuracy.

22. A method for faster and more accurate cutting of rectangular construction materials whereby use thereof will reduce construction costs by minimizing the amount of labor required to measure construction materials as well as minimizing material waste due to inaccurate cutting of construction materials, said method comprising the steps of providing a plurality of rectangular pieces of construction material, measurement marking means, and at least one cutting tool; using said measurement marking means to apply precise horizontal unit measurement markings and vertical unit measurement markings around the perimeter of at least one surface of each of said pieces of construction material; using said marking means to also apply a plurality of successively higher numbers onto each of said pieces of construction material so that each of said numbers becomes associated with one of said unit measurements markings; using said marking means to also apply a plurality of precise fractional markings onto each of said pieces of construction material between each of said horizontal unit measurement markings and vertical unit measurement markings; using said marking means to also apply a plurality of grid markings between said horizontal unit measurement markings and said vertical unit measurement markings so that said grid markings substantially fill the construction material surface of each of said pieces between said horizontal unit measurement markings and said vertical unit measurement markings; making each of said grid markings so that it has a spaced apart horizontal distance from the next adjacent one of said grid markings which is identical to the dimension of each of said horizontal unit measurement markings and a spaced apart vertical distance from the next adjacent one of said grid markings which is identical to the dimension of each of said vertical unit measurement markings; determining the horizontal and vertical dimensions of the cut required in each piece of construction material provided; identifying both visually and instantaneously the horizontal dimension of the required cut along one of said horizontal unit measurement markings on the perimeter of each of said pieces of construction material; subsequently identifying both visually and instantaneously the vertical dimension of the required cut along one of said vertical unit measurement markings on the perimeter of each of said pieces of construction material; and using said cutting tool to make the required cut between said identified horizontal unit measurement marking and said identified vertical unit measurement marking while concurrently using said grid markings to guide said cutting tool in a straight line path between each of said identified horizontal unit measurement markings and the corresponding ones or said identified vertical unit measurement markings.

23. The method of claim 22 further comprising the step of using said marking means to apply a plurality of visually precise fractional measurement markings in both horizontal and vertical directions onto said construction material surface between said grid markings.

24. The method of claim 22 wherein said step of providing marking means comprises the step of providing said marking means from a group consisting of screen printing equipment, laser printing equipment, and pad printing equipment.

* * * * *

UNITED STATES PATENT AND TRADEMARK OFFICE

CERTIFICATE OF CORRECTION

PATENT NO. : 5,673,489

DATED : October 7, 1997

INVENTOR(S) : Glenn Robell

It is certified that error appears in the above-identified patent and that said Letters Patent is hereby corrected as shown below:

Tittle Page, item [57]

Abstract - 8th word - delete "cuing" *and in its place insert* "cutting".

Column 3, line 58, prior to "construction materials. Grid" delete "eight foot" *and in its place insert* "twelve foot".

Column 4, line 8, after "markings" and prior to "a plurality" insert ",".

Column 4, line 9, after "markings" and prior to "and said vertical" delete ",".

Column 4, line 10, after "markings" and prior to "said grid markings substantially" insert ",".

Column 4, line 14, at the beginning of the line delete "arm" *and in its place insert* "apart".

Column 4, line 39, after "markings are" and prior to "from a group" delete "select" *and in its place insert* "selected".

"claim 4".

UNITED STATES PATENT AND TRADEMARK OFFICE

CERTIFICATE OF CORRECTION

PATENT NO. : 5,673,489

DATED : October 7, 1997

INVENTOR(S) : Glenn Robell

It is certified that error appears in the above-identified patent and that said Letters Patent is hereby corrected as shown below:

Column 5, line 4, after "piece of construction" delete "materials" *and in its place insert* "material so".

Column 5, line 6, after "cutting of construction" delete "material so" *and in its place insert* "materials".

Column 5, lines 29-30, after "between said unit" delete "measure merit" *and in its place insert* "measurement".

UNITED STATES PATENT AND TRADEMARK OFFICE

CERTIFICATE OF CORRECTION

PATENT NO. : 5,673,489

DATED : October 7, 1997

INVENTOR(S) : Glenn Robell

It is certified that error appears in the above-identified patent and that said Letters Patent is hereby corrected as shown below:

Column 5, line 44, after "of color" and before "markings, multiple lines,"

delete "enhance" *and in its place insert* "enhanced".

Signed and Sealed this

Second Day of June, 1998

*Attest:*

*Attesting Officer*

BRUCE LEHMAN

*Commissioner of Patents and Trademarks*